US008939681B2

(12) United States Patent
Pienaar et al.

(10) Patent No.: US 8,939,681 B2
(45) Date of Patent: Jan. 27, 2015

(54) PARTICULATE MATERIAL RETAINING BAG FOR WALL CONSTRUCTION AND EROSION CONTROL

(75) Inventors: Frans Petrus Roelof Pienaar, Krugersdorp (ZA); John Richard Thorpe, Durban (ZA)

(73) Assignees: Timrite (Pty) Ltd (ZA); Raffia Tufbag (Pty) Ltd (ZA)

( * ) Notice: Subject to any disclaimer, the term of this patent is extended or adjusted under 35 U.S.C. 154(b) by 568 days.

(21) Appl. No.: 12/678,574

(22) PCT Filed: Sep. 17, 2008

(86) PCT No.: PCT/ZA2008/000085

§ 371 (c)(1),
(2), (4) Date: Aug. 16, 2010

(87) PCT Pub. No.: WO2009/039536

PCT Pub. Date: Mar. 26, 2009

(65) Prior Publication Data

US 2011/0286687 A1 Nov. 24, 2011

(30) Foreign Application Priority Data

Sep. 17, 2007 (ZA) ..... 2007/06842
Sep. 17, 2007 (ZA) ..... 2007/07164

(51) Int. Cl.
*E02D 29/02* (2006.01)
*E02B 3/12* (2006.01)

(52) U.S. Cl.
CPC ..... *E02B 3/127* (2013.01)
USPC ..... 405/284; 405/289; 405/302.6; 383/3; 383/38; 383/120

(58) Field of Classification Search
USPC ..... 405/302.7, 302.6, 302.4, 288, 289, 284, 405/286, 287, 272; 220/9.4; 383/37, 38, 3, 383/120
See application file for complete search history.

(56) References Cited

U.S. PATENT DOCUMENTS 3,396,545 A * 8/1968 Lamberton ..... 405/233
3,886,751 A * 6/1975 Porraz Jimenez Labora 405/107

(Continued)

FOREIGN PATENT DOCUMENTS

BE 703 356 1/1968
CA 2265010 9/2000

(Continued)

OTHER PUBLICATIONS

International Search Report from corresponding PCT Application No. PCT/ZA2008/000085 dated Apr. 1, 2009.

(Continued)

*Primary Examiner* — Frederick L Lagman
(74) *Attorney, Agent, or Firm* — Grossman Tucker; Perreault & Pfleger PLLC

(57) ABSTRACT

This invention relates to a composite bag for use in earth bag construction systems such as backfill pack systems in underground mines and a construction system using such bags. The composite bags each comprises a pair of long, narrow inner bags of woven polypropylene located longitudinally within and constrained along their length by an outer bag of woven polypropylene. In use, the composite bags are laid flat on top of one another on a working surface (for instance the footwall in an underground mine). The bags could be glued or otherwise attached to one another in this configuration. Tie elements, such as timber elongates, are threaded through aligned slits spaced apart along the length of the bags. The elongates are set against the hanging wall and a backfill slurry is pumped into the inner bags. As each inflating composite bag expands, the slurry water weeps from the bags which rise up the timber elongates during the pumping process. The size differential between the two inner bags and the outer bag gives rise to the formation of a relatively straight line abutment between the two inner bags to provide a stable wall-like structure such as a mine ventilation wall or a backfill pack, as illustrated.

13 Claims, 3 Drawing Sheets

(56) References Cited

U.S. PATENT DOCUMENTS

| | | | | |
|---|---|---|---|---|
| 4,195,111 | A * | 3/1980 | Rautenbach | 405/288 |
| 5,059,065 | A * | 10/1991 | Doolaege | 405/115 |
| 5,125,767 | A | 6/1992 | Dooleage | |
| 5,615,979 | A * | 4/1997 | Lin | 405/288 |
| 5,669,732 | A * | 9/1997 | Truitt | 405/20 |
| 5,857,806 | A * | 1/1999 | Melin | 405/115 |
| 6,186,701 | B1 * | 2/2001 | Kempers | 405/19 |
| 6,364,571 | B1 * | 4/2002 | Doolaege | 405/115 |
| 6,715,960 | B2 * | 4/2004 | Metz | 405/116 |
| 6,783,300 | B2 * | 8/2004 | Doolaege | 405/115 |
| 2001/0002675 | A1 * | 6/2001 | Wilcox | 222/95 |
| 2004/0047688 | A1 * | 3/2004 | Clement | 405/115 |
| 2004/0096278 | A1 * | 5/2004 | Van Zyl | 405/289 |
| 2004/0146359 | A1 * | 7/2004 | Doolaege | 405/115 |
| 2005/0141965 | A1 | 6/2005 | Byrd et al. | |
| 2010/0003081 | A1 * | 1/2010 | Doolaege | 405/115 |
| 2010/0247249 | A1 * | 9/2010 | Skarbovig | 405/289 |

FOREIGN PATENT DOCUMENTS

| | | |
|---|---|---|
| CA | 2496084 | 8/2006 |
| CA | 2496090 | 8/2006 |
| DE | 102005010495 | 9/2006 |
| EP | 0368107 | 5/1990 |
| WO | 2006028435 | 3/2006 |
| ZA | 837719 | 10/1983 |
| ZA | 948660 | 11/1994 |
| ZA | 199887549 | 8/1998 |
| ZA | A2000/0228 | 3/2000 |
| ZA | F2000/0229 | 3/2000 |
| ZA | F2000/0230 | 3/2000 |
| ZA | 2000/5805 | 10/2000 |
| ZA | 2003/2325 | 3/2003 |
| ZA | 2003/8829 | 11/2003 |

OTHER PUBLICATIONS

International Preliminary Report on Patentability issued in PCT International Patent Application No. PCT/ZA2008/000085, dated Mar. 24, 2010, 10 pages.

Patent Examination Report issued in Australian Patent Application No. 2008302009, dated Dec. 9, 2013, 3 pages.

* cited by examiner

PARTICULATE MATERIAL RETAINING BAG FOR WALL CONSTRUCTION AND EROSION CONTROL

BACKGROUND TO THE INVENTION

This invention relates to sandbag or earth bag construction systems, to construction methods using sandbags or earth bags and to sandbags or earth bags, particularly mine backfill bags, for use in such systems and methods.

The earth bags and earth bag construction system of the invention can be applied in numerous applications, including erosion control, flood control, earth structure construction and remediation and even stand alone construction, as will be described in this specification. The invention finds particular application, however, in the placing of backfill in mines for mine support and mine ventilation purposes and it will be described largely with reference to such an application. It will be appreciated that these descriptions are purely illustrative and are not intended to limit the invention to any of the specific examples.

The terms "earth bag", "sand bag", "earth bag construction" and "sand bag construction" are used for convenience to indicate construction elements and methods of construction in which the basic elements of construction are filled bags. However, the use of these terms is not intended to limit the invention to the use of earth-like or sandy fill materials or even to particulate fill materials. It may be that the fill materials used in earth bag construction systems are typically constituted by earth-like or sandy particulate fill materials, but it will be appreciated that non-earth-like materials or even non-particulate materials can be used as fill materials, such as setting- or non-setting gels and foams. In certain applications it might even be possible to use a liquid such as water or a non-drying slurry as the fill material.

The construction system of this invention lends itself to the construction of structures in which one or more earth bags are first laid down on a working surface and additional earth bags are then layered or stacked on the bags so laid down. The term "stacking" implies substantially horizontal working surfaces and vertical, stacked structures, but this is not necessarily correct. The earth bags of the invention can be laid on a working surface, such as an inclined slope in a mine, that deviates substantially from straight and level. The construction system of this invention can also be used to construct walls and surfaces that deviate substantially from perpendicular relatively to a conventional geometrical horizon line. In addition, whilst the construction system lends itself to the construction of substantially vertical wall-like structures, the system can also be used for the construction of earth bag structures that are adapted to be overlaid side-by-side or nearly side-by-side, such as in a corbelled stack, over a horizontal or inclined surface or structure to be controlled or remediated.

In each case, however, the earth bags of the invention are laid down on a working surface.

It is an object of this invention to provide an earth bag construction system for mine backfill applications in particular and for erosion control, construction and numerous other applications in general. The particulate material bags of the invention find application, particularly, as mine support systems and, generally, as replacements for the earth or sandbags used in earth bag and sandbag structures, whether permanent structures or emergency structures, such as flood retaining walls.

SUMMARY OF THE INVENTION

This invention provides a composite particulate material retaining bag for erosion control and wall constructions using earth bag construction systems in which a plurality of the composite bags of the invention are to be laid down lengthwise on a working surface, the composite bag comprising a plurality of tubular inner bags located longitudinally coaxially within a tubular outer bag, the inner bags being juxtaposed with one another and arranged longitudinally coaxially relatively to one another and the outer bag, the composite bag including at least one filling inlet by means of which a fluid fill material may be transported into the inner bags to fill the inner bags and the combined cross-sectional size of the inner bags being greater than the cross-sectional size of the outer bag, such that the inner bags are constrained by the outer bag to act as a unitary bag.

The metric that is used to determine the cross-sectional size of the bags is essentially irrelevant and the term "cross-sectional size", in this specification, can be taken to refer to any one or more of bag width (preferably with the bag laid out flat), cross-sectional area, tubular circumference or any other cross-sectional size measurement means. If bag width is used as the metric, the combined flat widths of the inner bags must be greater than the flat width of the outer bag. If cross sectional area is used as the metric, the combined cross-sectional areas of the inner bags (measured when inflated normally and un-constrained by the outer bag) must be greater than the cross-sectional area of the outer bag. If tubular circumference is used as the metric, the combined tubular circumferences of the inner bags (measured separately of the outer bag) must be greater than the tubular circumference of the outer bag. In each case, the cross-sectional size differential will ensure that the inner bags are constrained by the outer bag to act as a unitary bag.

The fluid fill material may include any fluid that can be transported into a bag to fill the bag and preferably a fluid or fluidised particulate material that is capable of being transported hydraulically or pneumatically. The fluid fill materials used in typical earth bag construction methods normally do not extend further than poured or shoveled earth-like or sandy particulate fill materials. This invention is suited to the use of such earth-like or sandy particulate fill materials, including earth, soil, sand, earth-derived particulate materials such as particulate or crushed minerals, rocks, aggregates, soils, sands, mine tailings and other forms of mine or ore waste, including processed waste or even metal shot. Besides such earth-like particulate materials, the invention may include the use of non-earth-like particulate materials, including organic materials, such as particulate dried grains, legumes, vegetable husk and kernel waste materials. Suitable materials also include non-particulate materials, such as setting- or non-setting gels and foams. In certain applications it might even be possible to use simple, non-filled fluids such as liquids and gases, for instance water or air as the fill material.

By means of gusseting and folding the bags making up the composite bag may be pre-shaped to adopt a predetermined shape after filling and to permit more controlled expansion of the composite bag.

To this end, the composite bag, in a preferred form of the invention, has one or more of the outer bag and the inner bags gusseted and folded in lengthwise, preferably in longitudinally extending inwardly directed V-folds that are adapted to unfold during filling.

In one form of this embodiment of the invention, the longitudinally extending sides of the outer bag are folded in lengthwise, in longitudinally extending inwardly directed V-folds and the inner bags are positioned within the outer bag such that the longitudinally extending side edges of the inner bags on either longitudinally extending side of the outer bag, overlie the fold edge of the folded-in side of the outer bag.

The folded, gusseted bags are preferably adapted to present, after filling, substantially block-shaped bags with relatively straight longitudinally extending and transversely extending sides and relatively flat longitudinally extending surfaces across the width of each bag.

The inner bags may be internally connected for fluid flow between the inner bags.

To this end, the inner bags may be constituted by a single closed-ended tube that is folded back on itself intermediate its ends the number of times required to constitute the requisite number of inner bags.

In one form of this embodiment of the invention the composite bag may conveniently comprise a pair of inner bags located longitudinally within and constrained along their length by an outer bag, the inner bags being constituted by a single closed-ended constrained tube, the length of which is approximately double the length of the outer bag, the constrained tube being positioned within the outer bag and folded back upon itself intermediate its ends, such that the closed ends of the constrained tube are located adjacent one another at one end of the outer bag and the fold at the other end of the outer bag, the folded constrained tube halves being positioned substantially side by side within the outer bag.

To make the composite bags of the invention compatible with hydraulic or pneumatic fluid or fluidised material transport systems, the or each filling inlet may be provided with a closable inlet valve. Preferably the inner bags each have a dedicated filling inlet.

The bags are preferably but not necessarily of the weeping type.

Non-weeping bags are particularly suited for applications in which the fill material is a fluid or the transporting fluid is intended to bond chemically with the transported particulate material. For instance, the fluid and particulate material combination may be constituted by an initially fluid or plastic, settable material such as a settable gel, a concrete, a foam cement or a high-yielding expanding grout, the material of the bags being selected to retain the settable material at least until it has set.

Weeping bags are particularly suited for applications in which the transporting fluid is intended to separate from the transported particulate material by settlement, fluid exudation or otherwise, the material of the bags being selected to be porous to the fluid within which the particulate material is transported and the material being adapted to exude the fluid and to retain the particulate material when, in use, the particulate material and fluid is transported into the inner bags.

The porosity of the bags may conveniently be varied, with the fabric of the inner bags being selected more for particulate material retention and fluid exudation than pressure stress resistance and the fabric of the outer bag or tube being selected for pressure stress resistance and fluid exudation characteristics.

The invention includes an earth bag construction system including a plurality of composite bags as described above, the composite bags being adapted to be stacked on or otherwise juxtaposed with one another on a working surface and the composite bags being adapted, after filling, to each present a pair of opposed, substantially flat surfaces across the width of each bag, which flat surfaces are adapted to be juxtaposed with the corresponding flat surfaces of adjacent, similar composite bags to define a structure.

The composite bags may conveniently be formed with a plurality of tie element apertures, longitudinally spaced apart at predetermined intervals along the length of each composite bag, the system including a plurality of tie elements that are adapted to be threaded through the tie element apertures of similar composite bags juxtaposed with one another during construction, thereby to tie the bags to one another.

The tie element apertures in the composite bags may conveniently be constituted by diametrically opposed aperture pairs formed in the outer bags of the composite bags, the apertures being longitudinally spaced apart at predetermined intervals along the length of the composite bag and the system including a plurality of tie elements which are adapted to be threaded through the aperture pairs of similar composite bags juxtaposed with one another in use, thereby to tie the bags to one another, the aperture pairs being positioned on the dividing line or lines between the inner bags.

As an alternative to apertures, loop-like structures may be provided along at least the longitudinally extending sides of the composite bag to constitute tie element loops spaced apart along the length of the bag.

The composite bags may conveniently be pre-secured to one another in a predetermined juxtaposed arrangement of the bags relatively to one another, by gluing, stitching or the like, preferably by securement of the outer bags to one another.

The tie elements may be supported tie elements, being elements that are adapted for attachment to a working surface at either end of the tie element. Examples of such tie elements include ligature elements, such as cords, straps, ropes, chains or cables (steel wire ropes) or the like or even rods, posts or timber elongates that require securement at the operatively spaced apart ends thereof to structural elements between which a structure is to be constructed in use.

Alternatively or in addition, the construction system of the invention may include self-supporting tie elements, being tie elements that are adapted for attachment to a working surface at one end of the tie element only. Examples of such tie elements include relatively rigid rods, poles or the like that are adapted to support themselves on a working surface, whether planted in the surface or supported on a stand.

The construction system of this invention lends itself to the construction of substantially vertical wall-like structures in which the tie elements include tie elements that are adapted for securement of their ends to upper and lower working surfaces between which a wall-like structure is to be constructed in use. Examples of such upper and lower working surfaces include floor and soffit surfaces or footwall and hanging wall surfaces in a mine.

The earth bag construction system of the invention can also be used for the construction of earth bag structures that are adapted to be overlaid over a surface or structure to be controlled or remediated, in which event the tie elements may conveniently include supported tie elements that require securement, at their ends, to structural elements between which an overlay structure is to be constructed in use, such as ground anchors located on either side of the surface or structure to be controlled or remediated, which supported tie elements include ligature-type tie elements, such as cords, straps, ropes, chains and cables (steel wire ropes) and means to secure the ligature-type tie elements to the structural elements.

The invention further includes a method of constructing an earth bag structure using the construction system described above, including methods of constructing ventilation walls and backfill packs in underground mines.

The invention also extends to backfill pack and ventilation wall construction systems as will be seen from the description following.

BRIEF DESCRIPTION OF THE DRAWINGS

The invention will be further described with reference to the accompanying drawings in which.

DESCRIPTION OF EMBODIMENTS OF THE INVENTION

Figure 1:
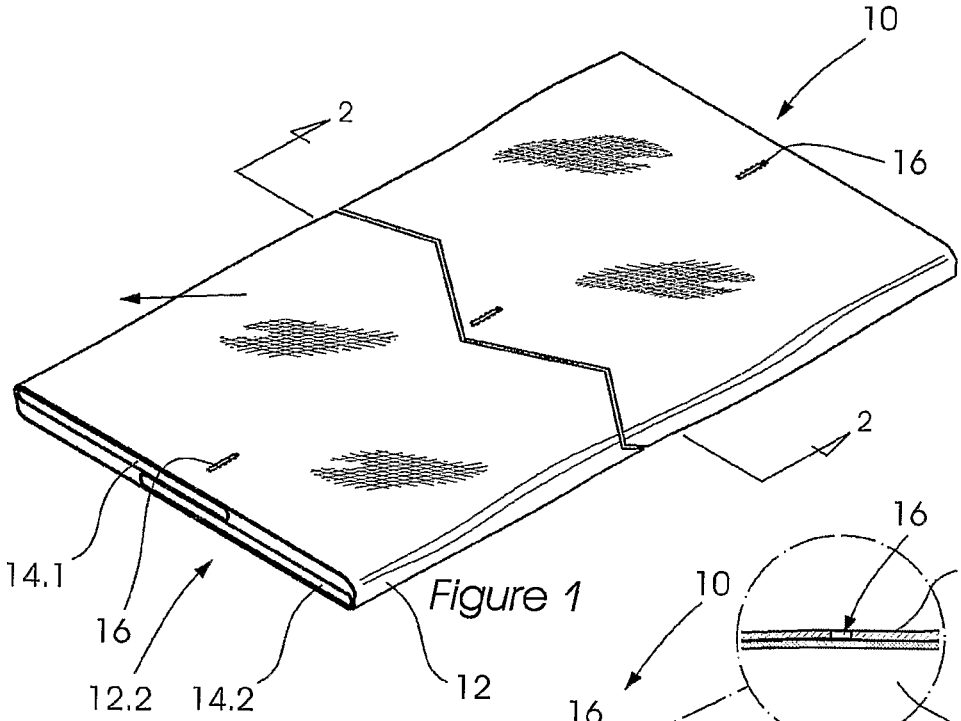
FIG. 1 is a diagrammatic isometric view of a composite particulate material bag according to the invention.

The drawings illustrate a specialised application of the invention in the form of a backfill pack system which is intended to provide active support to the hanging wall and footwall in underground mining. The resultant construction is essentially a mine support pack in which a backfill and cement grout mixture is pumped into the composite bags of the invention and allowed to set to support the hanging and footwalls against closure during mining operations.

The name "backfill" is derived from its original application in which a particulate material slurry is pumped into the worked-out "back areas" of stopping sections in a mine where it drains and dries sufficiently to become a load bearing material. Typical fill materials comprise materials which are substantially inert to reaction with binders or water, such as mine tailings and other forms of waste, crushed rockfill, aggregate, sands and mixtures of these, optionally with hydraulically setting binder additives such as cement, slag, pulverised fuel ash and the like. The fill is usually transported hydraulically to the void for placement as a pumped slurry of particulate materials in water.

In current mining practice in South African underground mines, the backfill material is no longer simply pumped back into worked out areas. The backfill material is typically mixed with a hydraulically setting binder, such as a cement grout, and the mixture is placed (by pumping) within bags, typically referred to as backfill bags. The backfill slurry is pumped into the bag under substantial pressure and after setting of the backfill/cement mixture, the bag serves as an active support between the footwall and the hanging wall. The process is expensive and laborious due to the use of bulky and hard to manage bags and the difficulties inherent in keeping a bag in position during filling with a fluid slurry. In addition, conventional backfill bags are of heavy duty materials which give rise to problems in dewatering of the slurry. In turn, this gives rise to slumping of the slurry in the bag prior to the placed slurry consolidating and attaining its predetermined setting properties. This results in the bag being incapable of providing active support without topping up or additional support by means of a grout bag or the like placed between the top of the bag and the hanging wall.

An early example of the use of backfill in underground mining is to be found in South African Patent No. 1983/07719—Anikem (Pty) Ltd. A more modern backfill bag is marketed by Reatile Timrite (Pty) Ltd, a South African company, under the trade mark TAUPAK™ (this product forms the subject of South African Patent No. 2005/5805). The bag is intended, after pumping, to constitute a mine support pack and consists of a number of discrete bag sections, each with a central aperture to allow placing of the individual bags about a single timber elongate or prop, the placing and setting of the prop being the only erection step required in the process. The prop is prestressed using a hydraulic prestressing pot. Each individual bag has a limited rise, so the number of bags used will depend on the stopping width at the point of installation. The bags are pumped individually from the base of the pack up to the hanging wall. No further handling is required as the bags slide up the elongate to the hanging wall as they are filled.

The bag 10 illustrated in FIGS. 1 to 4 is a backfill bag 10 that is to be used in a backfill bag pack system in which a watery slurry of backfill and cement grout is to be pumped into the composite bag and the water component of the slurry will be allowed to exude or weep from the bag 10. The fabric of preference for the bag 10 is woven polypropylene.

The bag 10 is a composite bag made up of a tubular outer bag 12 of woven polypropylene fabric that serves as a constraining outer bag. A pair of inner bags 14 of woven polypropylene are placed within and constrained by the outer bag 12. The composite bag 10 is substantially longer than it is wide, resulting in a relatively long, narrow bag 10 with a high surface area to volume ratio. The ends of the inner bags 14 are located adjacent one another at either end of the outer bag 12.

During assembly of the bag 10, the inner bags 14.1, 14.2 are inserted into the outer bag 12 and positioned substantially side by side within the outer bag 12.

Figure 2:
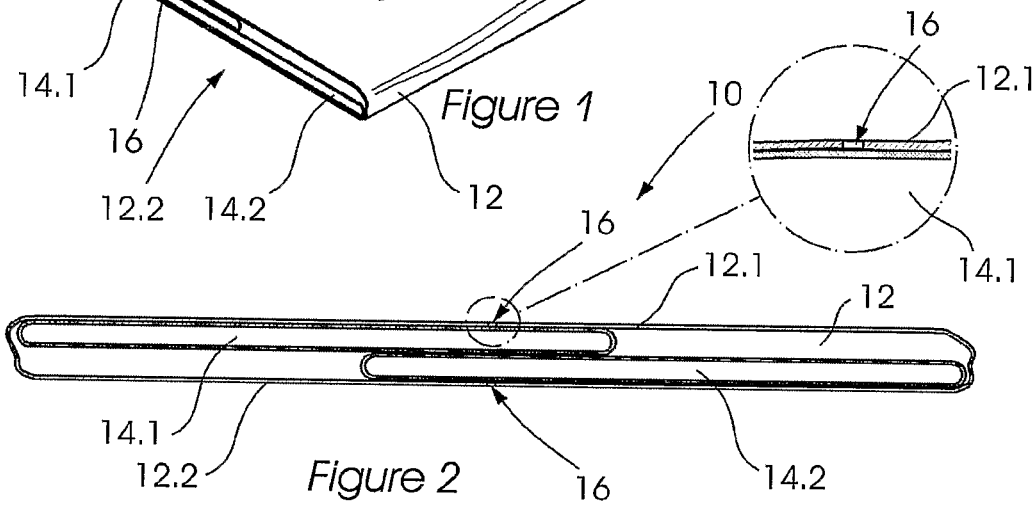
FIG. 2 is a diagrammatic section on a line 2-2 in FIG. 1.
Figure 3:
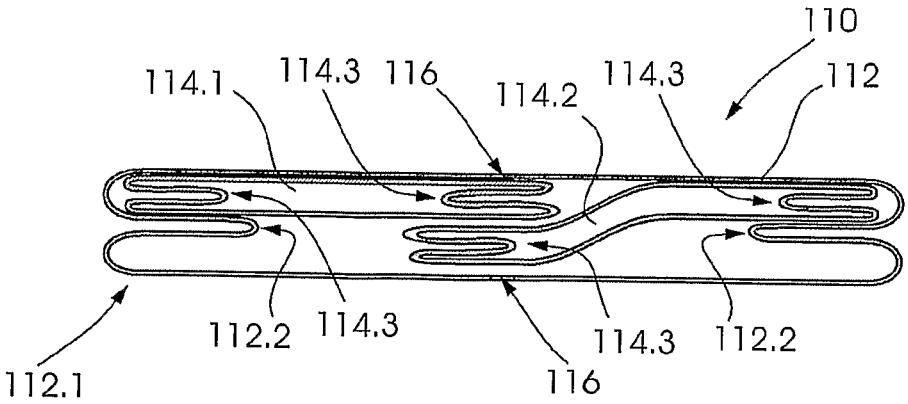
FIG. 3 is a similar diagrammatic section of an embodiment of the invention in which the longitudinally extending sides of the outer bag and the inner bags are folded in lengthwise.
Figure 4:
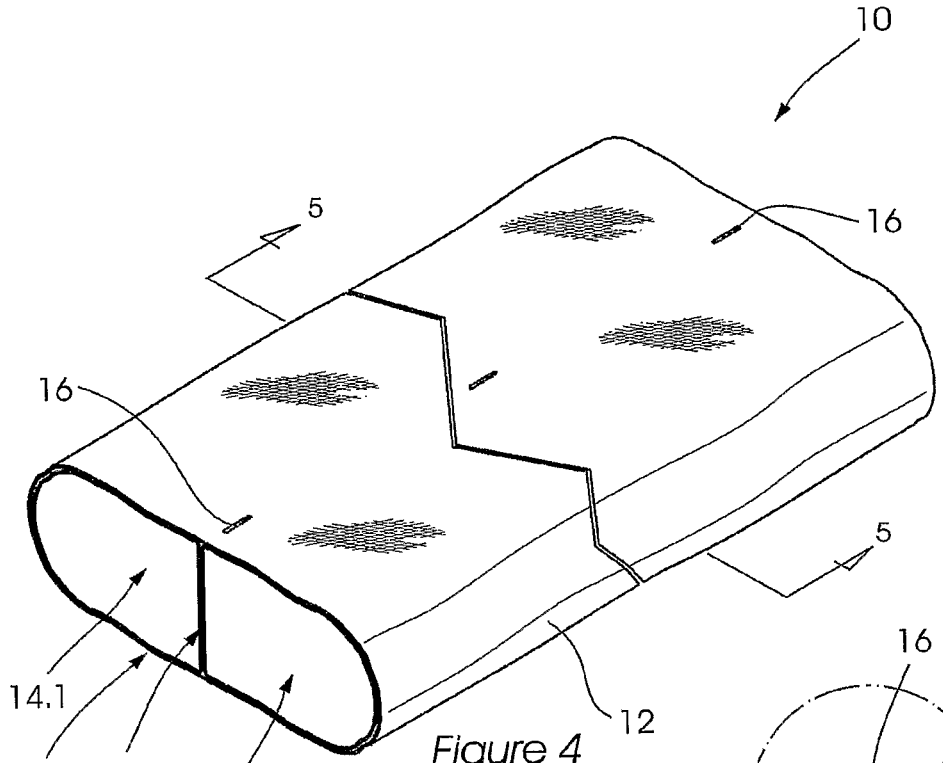
FIG. 4 is a diagrammatic isometric view of the composite particulate material bag of FIGS. 1 and 2, after inflation of the inner bags thereof.

As can be seen from FIGS. 2, 3 and 4, the cross-sectional size of each inner bag 14 is more than half the cross-sectional size of the outer bag 12 with the result that centrally located, longitudinally extending edge of the topmost inner bag 14.1 overlies the central edge of the inner bag 14.2 along the longitudinally extending centre line of the outer bag 12.

A similar bag 110 is illustrated in FIG. 3 in a cross section similar to FIG. 2—the folding and vertical positioning of the bags making up the composite bag 110 is slightly exaggerated in FIG. 3 for illustrative purposes. References to the composite bag 10 of FIGS. 1, 2, 4 and 5 and its numbered parts are, unless inconsistent with the context, also intended to be references to the bag 110 and its similarly numbered parts. In this embodiment of the invention the longitudinally extending sides 112.1 of the constraining outer bag 112 are folded in lengthwise, in longitudinally extending inwardly directed V-folds 112.2.

The inner bags 114 are positioned side by side within the outer bag 112. As a result of the greater cross-sectional size of the inner bags 114 relatively to the outer bag 112, the inner bag 114.1 overlies the other inner bag 114.2 longitudinally along the longitudinally extending centre line of the outer bag 112. The longitudinally extending sides of each inner bag is folded in lengthwise, resulting in a pair of longitudinally extending inwardly directed V-folds 114.3 that run the length of the bag 110 along the opposed long sides of each of the inner bags 114, 114.2.

The V-folds 112.2 on the outer bag 112 and the V-folds 114.3 on the inner bags 114.1, 114.2 are produced by gusseting the ends of the bags 112, 114 to provide the bags with blocked ends. The folded, gusseted bags 114, 112 shape the bag 110 to present, after filling, a substantially block-shaped, inflated bag with relatively straight longitudinally and transversely extending sides and relatively flat longitudinally extending surfaces across the width of the bag 110 that allow for easy and secure stacking of the bag 110 on similar bags 110.

Figure 5:
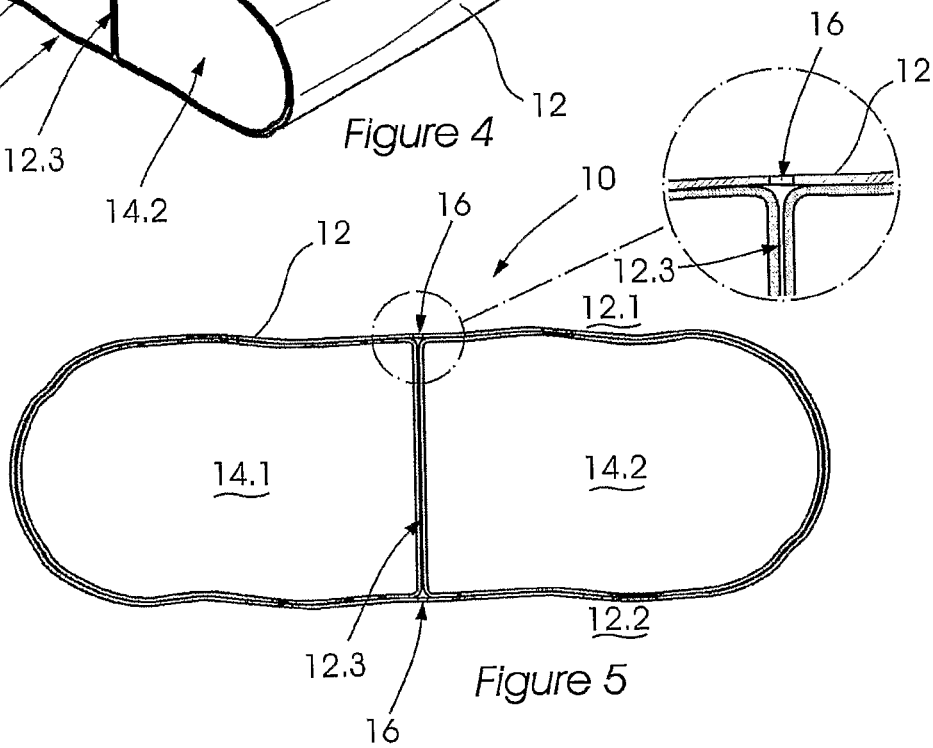
FIG. 5 is a section on a line 5-5 in FIG. 4.

As a result of the greater cross-sectional size of the inner bags 14, the total combined cross-sectional size of the inner bags 14.1, 14.2 is greater than the cross-sectional size of the outer bag 12. This size differential assists in creating a relatively flat bag when the inner bags are filled with backfill (FIGS. 4 and 5 show the bag 10 after pumping). Due to this size differential, the two inner bags 14.1, 14.2 fill up to form a central abutment 12.3 where their inner walls butt up against one another during pumping.

This effect is further enhanced by gusseting the bags. Also, the positioning of the inner bags 114.1, 114.2 over the V-folds 112.2 of the outer bag (as illustrated in FIG. 3), results in trapping of the V-folds 112.2 of the outer bag 112 under the edges of the inner bags 114 during pumping. This tends to force the pumped-in backfill slurry towards the centre of the bag 110, thereby rationalising the expansion of the inner bags 114.1, 114.2 and improving the quality of the pumped bag 110.

In addition, gusseting of the bags 112, 114 creates a more compact, gusseted bag 110 which, even when empty, has substantially the same shape and dimensions, in plan outline, as the inflated, filled bag, making positioning of the bag in situ much easier.

At least the outer bag 12, 112 is gusseted at both ends to facilitate the formation of a flat bag after pumping and to provide substantially block-shaped ends after filling of the inner bags 14, 114. For smaller bags, gusseting is not that important, but with larger sizes (such as backfill packs for instance) it is important to gusset both inner bags 14, 114 and outer bags 12. 112.

The upper surface 12.1 of the outer bag 12 is formed with a series of matching pairs of slits 16 spaced apart from one another along the length of the composite bag 10, as is the lower surface 12.2 of the outer bag 12, which has similar slits 16 formed therein. The slits 16 constitute diametrically opposed aperture pairs spaced apart at predetermined intervals along the length of the composite bag.

The slits 16 define tie element apertures for a plurality of tie elements (constituted by timber elongates—FIGS. 6 to 8) that are adapted to be threaded through the aperture pairs 16 of similar composite bags 10 juxtaposed with one another, thereby to tie the bags 10 to one another. The aperture pairs 16 are positioned in line with the notional line of separation between the inner bags 14.1, 14.2, being the line separating the inner bags after inflation of the inner bags.

In a composite bag with two inner bags 14.1, 14.2, the opposed tie element apertures (slits 16) are positioned along the centre line of the outer bag 12 on the top (12.1) and bottom (12.2) surfaces of the composite bag 10.

The slits 16 are intended to accommodate tie elements (not shown in FIGS. 1 to 5) by means of which the bags 10 are to be tied to one another during the construction of earth bag structures using the bags 10, 110 of the invention.

The bag 110 of FIG. 3 may be formed with similar slits 116 that are intended to serve the same purpose as the slits 16 in the bag 10.

The inner bags 14.1, 14.2 are provided with closable filler valves (not shown in FIGS. 1 to 5) that extend through the outer bag 12 and through which a backfill and cement grout mixture can be pumped into the inner bags 14.1, 14.2 using conventional mine backfill pumping systems.

To facilitate dewatering of the backfill slurry after it has been pumped into the composite bag 10, the fabric of the outer bag 12 is selected for pressure stress resistance and maximum porosity, while the fabric of the inner bags 14 is selected for porosity over pressure stress resistance, without compromising backfill and grout fines retention. The outer bag 12 takes up the greater proportion of the pressure stress of inflation of the bag 10 during pumping and the inner bags 14.1, 14.2 need therefore not be highly pressure-resistant. Rapid dewatering of the pumped-in slurry is also promoted by the fact that the dimensions of the composite bag 10 are such that the ratio of the bag surface area to bag volume is relatively high, thereby giving rise to rapid fluid exudation during pumping.

Figure 6:
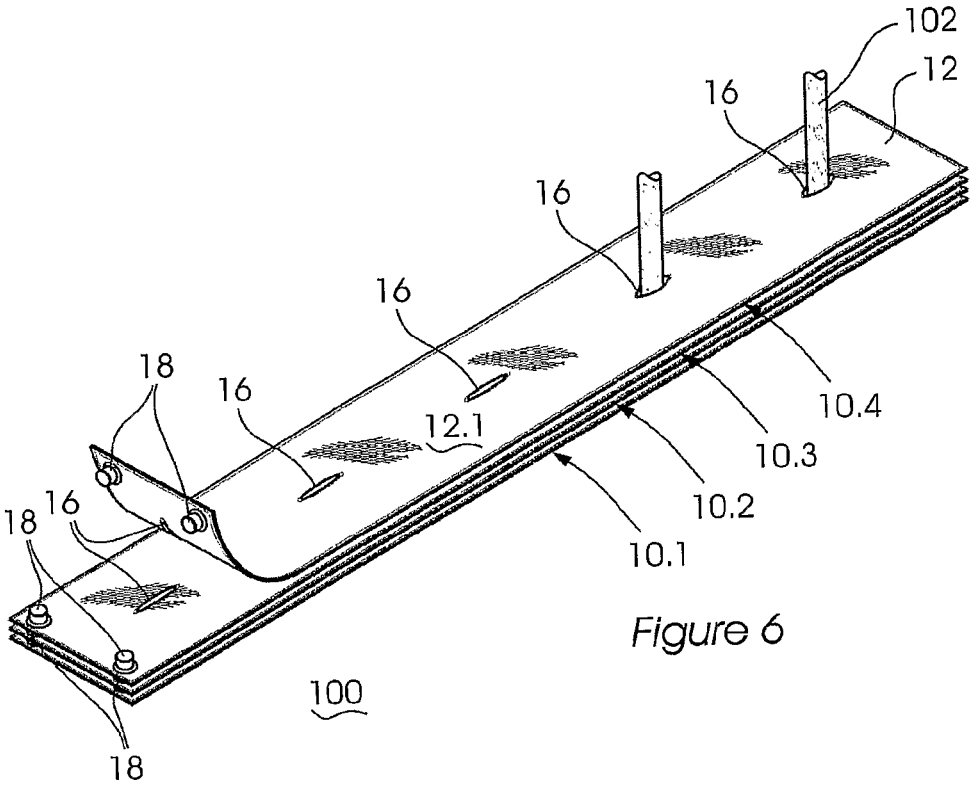
FIG. 6 is a diagrammatic isometric view of a plurality of particulate material bags in which the construction system of this invention is applied as active backfill mine support.
Figure 7:
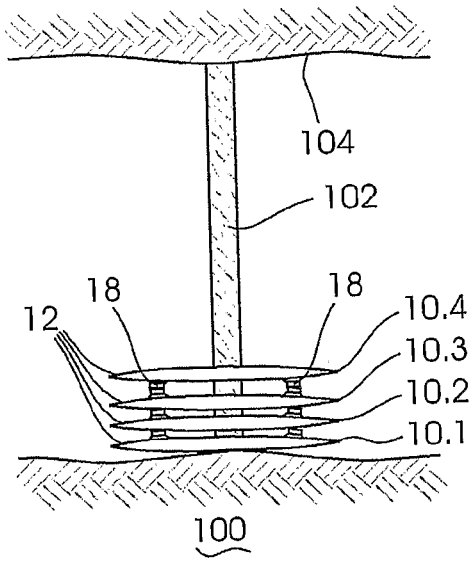
FIG. 7 is an end elevation on the backfill instillation of FIG. 6, showing the composite particulate material bags prior to inflation of the bags.
Figure 8:
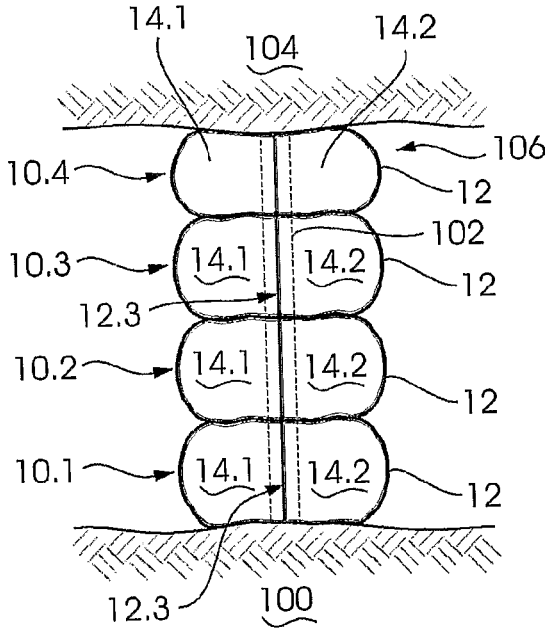
FIG. 8 is section through the installation of FIGS. 6 and 7 after inflation of the bags.

An application of the composite bag of the invention, in which is it used in the construction of a walled structure in the form of a backfill pack in an underground mine, is illustrated in FIGS. 6 to 8. A typical use for such a backfill pack would be to provide support between the hanging wall and footwall across a longitudinally extending area (greater than the point support provided by conventional mine support packs and props).

In FIG. 7, four of the composite bags 10 have been laid flat on top of one another on a working surface constituted by the footwall 100 in an underground mine. The composite bags may conveniently be attached to one another in the stacked, pre-erection arrangement illustrated in FIG. 7 prior to delivery to the installation site. The bags 10 may be attached to one another by gluing, stitching, stapling or the like, gluing at key points along the bags (such as the ends of the bags 10) being preferred.

A plurality of tie elements in the form of timber elongates 102 (shown in FIG. 6 in part only) are threaded through the aligned slits 16 of the bags 10. The elongates 102 are set against the hanging wall 104 by conventional means, such as chocks and wedges (not shown). In positioning the elongates within the slits 16, care is taken to ensure that the inner bags 14.1, 14.2 are held clear of the elongates 102, the inner bags 14.1, 14.2 being shifted aside in the slit area to allow the elongate 102 to extend from the slit 16 on the upper surface 12.1 of each bag 10 to the slit 16 on the lower surface 12.2. For convenience and to protect the inner bags 14.1, 14.2 against snagging and entrapment, elongate guides in the form of short rigid, semi-rigid or flexible tubes (not shown) may be inserted or pre-inserted through the slits 16 of all the bags 10, from the bottom to the top of the stack, ready to guide the insertion of the elongates 102.

The composite bags 10 can now be filled with a pumped-in backfill slurry which is pumped into the inner bags 14.1, 14.2 of each of the composite bags 10 through pressure resistant, closeable inlet valves 18 fitted to each of the bags 10.

The lowermost bag 10.1 is pumped first until the inner bags 14.1, 14.2 thereof are fully inflated whereupon the remaining bags 10.2, 10.3, 10.4 are pumped in sequence.

In each case, as the bags 14.1, 14.2 are pumped with backfill, the inflating composite bag 10 expands and rises up the timber elongates 102 from the configuration shown in FIG. 7 to that shown in FIG. 8. During the pumping process, the lowermost and uppermost bags 10.1, 10.4 take up the contours of the footwall 100 and hanging wall 104 respectively.

Referring to FIGS. 4, 5 and 8, it can be seen how the size differential between the two inner bags 14.1, 14.2 and the outer bag 12 gives rise to the formation of a relatively straight line abutment between the two inner bags 14.1, 14.2 within the outer bag 12, thereby greatly enhancing the stability of the bag 10 and assisting in the formation of a relatively flat bag 10 with flat, parallel upper (12.1) and lower (12.2) surfaces. This results in a stable stack to define the wall-like structure constituted by the backfill pack 106 (in FIG. 8).

If required (if there is any slumping detected in the pumped-in slurry after the lower bags 10.1, 10.2, 10.3 have set), the upper bag 10.4 can be pumped or topped up at a later stage, either to counteract slumping in the pumped-in slurry or even to pre-stress the backfill pack 106.

In the backfill pack 106 illustrated in FIG. 8, the timber elongates 102 function to provide active support, but it is possible (for appropriate applications) to design a pack 106 in which all the support is provided by the bags 10, from installation of the pack. In such an application, the elongates will serve simply to provide a framework for the erection of the bags 10 and substantially lighter elongates can be used or even substituted with non-load-bearing tie elements such as steel wire ropes connected to the hanging- and footwalls.

Exemplary dimensions for a backfill pack 106 would be a pumped bag width of 1.5 m, which can be used to provide a backfill pack for stop widths of 2 m or greater. Larger structures are of course possible using wider bags 10. The bags 10 are between 5 m and 6 m long, but there is no reason (other than the practicalities of pumping) why the bags 10 should not be longer, even up to 100 m long.

A virtually identical structure to that illustrated in FIGS. 6 to 8 can be used to construct mine ventilation walls, in which case substantially narrower bags 10 can be used with much lighter elongates 102. Bags 10 with a pumped width of 300 mm, can be used to construct ventilation walls anything up to 2 m high or higher. Such bags may conveniently be between 5 m and 6 m long but there is no reason (other than the practicalities of pumping) why the bags 10 should not be longer, even up to 100 m long. A bag 10 with a pumped width of 500 mm could be used to erect ventilation walls up to 5 m high. In such a system, the narrower bags might need less gusseting and lengthwise folding and either or both the inner and the outer bags can dispense with gusseting and folding.

The bags 10 and earth bag construction system of the invention provides improved safety conditions and protection for workers, particularly for backfilling operations in underground mining.

The invention claimed is:

1. A composite particulate material retaining bag for wall construction and erosion control, the composite bag comprising a plurality of tubular inner bags located within a tubular outer bag, the inner bags being juxtaposed with one another and arranged longitudinally coaxially relatively to one another and the outer bag, the composite bag including at least one filling inlet by means of which a fluid fill material may be transported into the inner bags to fill the inner bags, the material of the bags being selected to be porous to the fluid within which the particulate material is transported and, after the fluid fill material has been transported into the inner bags in use, to exude the fluid and retain the particulate material, and wherein the sum of each cross-sectional width of the unfilled inner bags is greater than the cross-sectional width of the unfilled outer bag.

2. The composite bag according to claim 1, wherein the longitudinally extending sides of the outer bag is folded in lengthwise, in longitudinally extending inwardly directed V-folds that are adapted to unfold during filling.

3. The composite bag according to claim 2, wherein the inner bags are positioned within the outer bag such that the longitudinally extending side edges located along the longitudinally extending side of the outer bag, each overlies the fold edge of the folded-in side of the outer bag.

4. A composite bag according to claim 2, wherein the ends of one or more of the inner and outer bags are gusseted.

5. The composite bag according to claim 2, wherein the longitudinally extending sides of one or more of the inner bags is folded in lengthwise, in longitudinally extending inwardly directed V-folds that are adapted to unfold during filling.

6. The composite bag according to claim 1, wherein the longitudinally extending sides of one or more of the inner bags is folded in lengthwise, in longitudinally extending inwardly directed V-folds that are adapted to unfold during filling.

7. The composite bag according to claim 1, wherein the inner bags are constituted by a single closed-ended tube that is folded back on itself intermediate its ends the number of times required to constitute the requisite number of inner bags.

8. The composite bag according to claim 7 comprising a pair of inner bags located longitudinally within and constrained along their length by an outer bag, the inner bags being constituted by a single closed-ended constrained tube, the length of which is approximately double the length of the outer bag, the constrained tube being positioned within the outer bag and folded back upon itself intermediate its ends, such that the closed ends of the constrained tube are located adjacent one another at one end of the outer bag and the fold at the other end of the outer bag, the folded constrained tube halves being positioned substantially side by side within the outer bag.

9. The composite bag according to claim 1, wherein the fabric of the inner bags is selected for particulate material retention and fluid exudation and the fabric of the outer bag is selected for particulate material retention, fluid exudation and pressure stress resistance.

10. A construction system comprising:

a plurality of composite bags, each of the composite bag comprising a plurality of tubular inner bags located within a tubular outer bag, the inner bags being juxtaposed with one another and arranged longitudinally coaxially relatively to one another and the outer bag, the composite bag including at least one filling inlet by means of which a fluid fill material may be transported into the inner bags to fill the inner bags, the material of the bags being selected to be porous to the fluid within which the particulate material is transported and, after the fluid fill material has been transported into the inner bags in use, to exude the fluid and retain the particulate material, and wherein the sum of each cross-sectional width of the unfilled inner bags is greater than the cross-sectional width of the unfilled outer bag;

wherein, the composite bags are configured to be stacked on or otherwise juxtaposed with one another on a working surface, the composite bags being adapted, after filling, to each present a pair of opposed, substantially flat surfaces across the width of each bag, which flat surfaces are adapted to be juxtaposed with the corresponding flat surfaces of adjacent, similar composite bags to define a structure.

11. The construction system according to claim 10, wherein the composite bags are formed with a plurality of tie element apertures, longitudinally spaced apart at predetermined intervals along the length of the composite bag, the system including a plurality of tie elements that are adapted to be threaded through the tie element apertures of similar composite bags juxtaposed with one another in use, thereby to tie the bags to one another, the tie apertures being positioned on the dividing line or lines between the inner bags located within the outer bag.

12. The construction system according to claim 11, wherein the tie elements include at least one supported tie element, being a tie element that is adapted for attachment to a working surface at either end of the tie element.

13. The construction system according to claim 11, wherein the tie elements include at least one supported tie element, being a tie element that is adapted for attachment to a working surface at one end of the tie element only.

* * * * *